US008330119B2

(12) United States Patent
Chen et al.

(10) Patent No.: US 8,330,119 B2
(45) Date of Patent: Dec. 11, 2012

(54) ON-LINE AND OFF-LINE COUPLING OF EC WITH DESI-MS

(75) Inventors: Hao Chen, Athens, OH (US); Jiwen Li, Athens, OH (US); Zhixin Miao, Athens, OH (US); Yun Zhang, Athens, OH (US)

(73) Assignee: Ohio University, Athens, OH (US)

( * ) Notice: Subject to any disclaimer, the term of this patent is extended or adjusted under 35 U.S.C. 154(b) by 644 days.

(21) Appl. No.: 12/558,819

(22) Filed: Sep. 14, 2009

(65) Prior Publication Data

US 2010/0258717 A1 Oct. 14, 2010

Related U.S. Application Data

(60) Provisional application No. 61/168,277, filed on Apr. 10, 2009, provisional application No. 61/182,318, filed on May 29, 2009.

(51) Int. Cl.
*H01J 49/26* (2006.01)

(52) U.S. Cl. ..... 250/425; 250/281; 250/288; 250/423 R; 250/424; 204/230.2

(58) Field of Classification Search ..... 250/281, 250/288, 423 R, 424, 425; 204/230.2
See application file for complete search history.

(56) References Cited

U.S. PATENT DOCUMENTS 5,879,949 A * 3/1999 Cole et al. ..... 436/173
6,952,013 B2 * 10/2005 Granger et al. ..... 250/288
7,335,897 B2 * 2/2008 Takats et al. ..... 250/425
7,915,579 B2 * 3/2011 Chen et al. ..... 250/288
2005/0230635 A1 * 10/2005 Takats et al. ..... 250/424
2009/0095899 A1 * 4/2009 Whitehouse et al. ..... 250/282
2009/0309020 A1 * 12/2009 Cooks et al. ..... 250/282
2010/0044560 A1 * 2/2010 Basile et al. ..... 250/282
2010/0059674 A1 * 3/2010 Chen et al. ..... 250/288

OTHER PUBLICATIONS

F. Zhou and GJ Van Berkel, "Electrochemistry Combined On-Line with Electrospray Mass Spectrometry." Anal. Chem. (1995) 67:3643-3649.
C.F. Bökman, et al., "A Setup for the Coupling of a Thin-Layer Electrochemical Flow Cell to Electrospray Mass Spectrometry." Anal. Chem. (2004) 76(7):2017-2024.
Z. Miao and H. Chen, "Analysis of Continuous-Flow Liquid Samples by Desorption Electrospray Ionization Mass Spectrometry (DESI-MS)." Proc. 56th Ann. Am. Soc. Mass Spectrom. Conf. Denver, CO, Jun. 1-5, 2008.
Zhixin Miao and Hao Chen, "Direct Analysis of Liquid Samples by Desorption Electrospray Ionization-Mass Spectrometry (DESI-MS)", J. Am. Soc. Mass Spectrom., 2009, 20, 10-19.
Z. Takáts, et al., "Electronsonic Spray Ionization. A Gentle Technique for Generating Folded Proteins and Protein Complexes in the Gas Phase and for Studying Ion-Molecule Reactions at Atmospheric Pressure." Anal. Chem. (2004) 76:4050-4058.
C.C. Mulligan, et al., "Fast Analysis of High-Energy Compounds and Agricultural Chemicals in Water with Desorption Electrospray Ionization Mass Spectrometry." Rapid Comm. Mass Spectrom. (2007) 21:3729-3736.

(Continued)

*Primary Examiner* — Michael Logie
(74) *Attorney, Agent, or Firm* — Wood, Herron & Evans, LLP

(57) ABSTRACT

An apparatus for direct analysis of the redox products, or intermediates, of an electrochemical reaction by coupling an electrochemical cell to desorption electrospray ionization mass spectrometry.

38 Claims, 9 Drawing Sheets

OTHER PUBLICATIONS

H. Chen, et al., "Extractive Electrospray Ionization for Direct Analysis of Undiluted Urine, Milk, and Other Complex Mixtures without Sample Preparation." Chem. Comm. (2006) 2042-2044.

G. Hambitzer and J. Heitbaum, "Electrochemical Thermospray Mass Spectrometry." Anal. Chem. (1986) 58:1067-1070.

M. Barber, et al., "Fast Atom Bombardment Mass Spectrometry." Anal. Chem. (1982) 54:645A-657A.

A. Bond, et al "A Role for Electrospray Mass Spectrometry in Electrochemical Studies." Anal. Chem. (1995) 67: 1691-1695.

H. Deng, et al., "Electrochemically Modulated Liquid Chromatography Coupled with On-Line Electrospray Mass Spectrometry." Anal. Chem. (2000) 72: 2641-2647.

W. Lu, et al. "On-line Linear Sweep Voltammetry-Electrospray Mass Spectrometry." Anal. Chem.(1997) 69:2478-2484.

H.P. Permentier and A.P. Bruins, "Electrochemical Oxidation and Cleavage of Proteins with On-Line Mass Spectrometric Detection: Development of an Instrumental Alternative to Enzymatic Protein Digestion." J. Am. Soc. Mass Spectrom. (2004) 15:1707-1716.

Y. Zhang and H. Chen, "Detection of saccharides by reactive desorption electrospray ionization (DESI) using modified phenylboronic acids." J. Int. Mass Spectrom., (2010) 289: 98-107.

* cited by examiner

ON-LINE AND OFF-LINE COUPLING OF EC WITH DESI-MS

This application claims the benefit of U.S. Provisional Patent Application Ser. Nos. 61/168,277, filed on Apr. 10, 2009, and 61/182,318, filed on May 29, 2009, the disclosures of which are also incorporated herein by reference.

TECHNICAL FIELD

The present invention is related to apparatii for coupling electrochemistry with mass spectrometry and methods of using the same.

BACKGROUND

Ambient mass spectrometry is a recent advancement in the field of analytical chemistry and has allowed for the analysis of samples with little-to-no sample preparation. Based on this concept, a variety of ambient ionization methods have been introduced, including desorption electrospray ionization (DESI), direct analysis in real time (DART), desorption atmospheric pressure chemical ionization (DAPCI), electrospray-assisted laser desertion/ionization (ELDI), matrix-assisted laser desorption electrospray ionization (MALDESI), extractive electrospray ionization (EESI), atmospheric solids analysis probe (ASAP), jet desorption ionization (JeDI), desorption sonic spray ionization (DeSSI), desorption atmospheric pressure photoionization (DAPPI), plasma-assisted desorption ionization (PADI), and dielectric barrier discharge ionization (DBDI).

DESI is a representative method for ambient mass spectrometry. It has been shown to be useful in providing a rapid and efficient means of desorbing and ionizing a variety of target compounds of interest under ambient conditions. For example, analytes such as pharmaceuticals, metabolites, drugs of abuse, explosives, chemical warfare agents, and biological tissues have all been studied with these ambient ionization methods.

In U.S. application Ser. No. 12/205,236, DESI has been shown to analyze liquid samples without the use of filters. Still, it would be useful to use the liquid DESI apparatus in combination with electrochemical cells to allow mechanistic study of reduction-oxidation (redox) and electrolysis reactions, particularly for bioanalytical applications. In conventional applications, the coupling of EC with MS has been accomplished with ionization methods such as thermospray (TS), fast atom bombardment (FAB), and electrospray ionization (ESI). In particular, the latter method is useful in ionizing non-volatile products or intermediates of electrochemical reactions. However, in coupling EC with ESI, the EC system needs to be electrically floated, or decoupled from the ionization source to separate the high voltage operation of the ionization source from the low voltage operation of the EC cell. This decoupling increases the complexity of the apparatus and the methods of analysis. Accordingly, it would be beneficial to develop an apparatus and ionization method that simplifies the coupling of EC with MS by removing the need for electrical floating or decoupling. It would be also beneficial to remove the dead connection volume between the EC cell and the ionization source, which would shorten the coupling system response time and enable the detection of short-life transient species that are formed during electrolysis. It would be further beneficial to develop a system that has a high salt tolerance to allow for more choices in selecting electrolytes. Finally, a system is needed that can perform analysis of a small volume of sample analytes, which would allow for high throughput analysis.

SUMMARY

In one illustrative embodiment of the present invention, an electrochemical liquid sample ionizer is described. The electrochemical liquid sample ionizer includes an electrochemical cell and a potential bias that is coupled to the electrochemical cell. The potential bias provides an energy to the liquid sample that is sufficient to oxidize or reduce a liquid sample in the electrochemical cell. An ambient ionizer is configured to desorb and ionize at least a portion of the liquid sample.

In another aspect of the illustrative embodiment, the electrochemical cell is a thin-layer electrochemical cell or a tubular flow-through electrochemical cell.

In yet another illustrative embodiment, an electrochemical liquid sample ionizer is described. The electrochemical liquid sample ionizer includes a droplet of liquid sample disposed between first and second electrodes. A potential bias is coupled to the electrodes and provides an energy that is sufficient to oxidize or reduce the liquid sample of the droplet between the electrodes. An ambient ionizer is configured to desorb and ionize at least a portion of the liquid sample.

Another illustrative embodiment is directed to a mass spectrometer that includes an electrochemical liquid sample ionizer.

The objects and advantages of the present invention will be further appreciated in light of the following detailed description and drawings provided herein.

BRIEF DESCRIPTION OF THE DRAWINGS

The accompanying drawings, which are incorporated in and constitute a part of this specification, illustrate embodiments of the invention and, together with a general description of the invention given above and the detailed description given below, serve to explain the principles of the invention.

DETAILED DESCRIPTION

Figure 1:
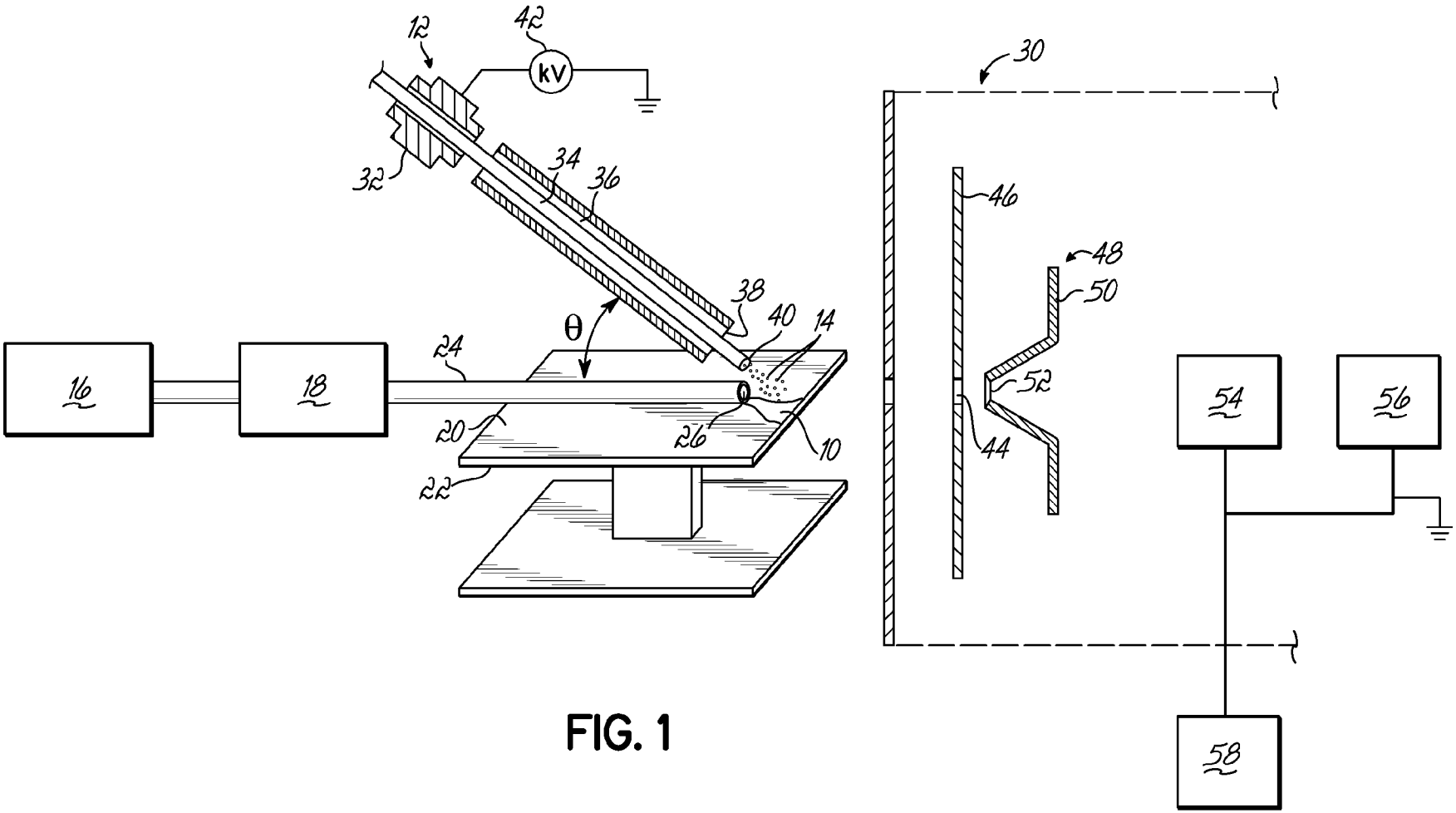
FIG. 1 is a diagrammatic view of an exemplary embodiment of an ionization apparatus with a mass spectrometer shown in cross-section.

The liquid sample desorption electrospray ionization mass-spectrometry (LS-DESI-MS) apparatus was described in detail in U.S. patent application Ser. No. 12/205, 236, the disclosure of which is incorporated in its entirety herein by reference. Briefly, FIG. 1 illustrates the LS-DESI-MS apparatus where an analyte from a liquid sample 10 is ionized by desorption of the analytes with a nebulizing ionizer 12. The nebulizing ionizer 12 generates a charged and nebulized solvent 14 under ambient conditions. The LS-DESI-MS apparatus forms gas phase ions that can be analyzed by mass spectrometry.

Operation of the LS-DESI-MS apparatus begins with a liquid sample 10 supplied from an electrochemical cell as discussed below. The liquid sample 10 is pumped from a sample supply 16 via a pump 18, such as a continuous-flow or syringe pump, and through a conduit, illustrated as a tube 24, onto a surface 20 of a sample stage 22. One suitable continuous-flow pump 18 can be a Chemyx Model F100 syringe pump (Houston, Tex.), which is operable at flow rates that range from about 0.1 μL/min to about 10 μL/min. At these rates, an adequate supply of the liquid sample 10 is available on the sample stage 22 for analysis but without excess puddling, which can result in splashing and a short-lived ion signal. Other flow pumps and flow rates could also be used.

The tube 24 can be constructed from a non-reactive material, such as silica, stainless steel, or aluminum, and can have an inner diameter ranging from about 0.05 mm to about 0.1 mm. However, the tube 24 should not be considered so limited.

The liquid sample 10 moves continuously by way of the continuous-flow pump 18, through the tube 24, and to a distally located opening 26, which is positioned on the sample stage 22. Though not specifically shown, the tube 24 can be affixed to the surface 20 of the sample stage 22, such as by a clamp, which will prevent movement of the opening 26.

In the illustrative embodiment, the sample stage 22 is a planar surface and can be constructed from any nonreactive material, such as polytetrafluoroethylene (PTFE). The design of the sample stage 22 can vary, but should be suitable to accommodate the tube 24 and a nebulizing ionizer 12 such that at least a portion of the liquid sample 10 can be desorbed and directed substantially toward a mass analyzer 30 according to methods discussed in detail below.

Once the liquid sample 10 is supplied to the sample stage 22, at least a portion of the liquid sample 10 is desorbed by the charged and nebulized solvent 14 emitted from the nebulizing ionizer 12. The nebulizing ionizer 12 can be an ESSI apparatus that includes a housing 32 having a solvent conduit 34 surrounded by a gas conduit 36; however, it would be understood that any ambient ionizing apparatus could be used. An outlet 38 of the gas conduit 36 is positioned about 0.1 mm to about 0.2 mm proximally to an outlet 40 of the solvent conduit 34. The solvent conduit 34 can be constructed from a fused silica capillary with an inner diameter ranging from about 5 μm to about 100 μm. The gas conduit 36 can also be a fused silica capillary with an inner diameter that is generally larger than the outer diameter of the solvent conduit 34, i.e., typically about 0.25 mm; however, these dimensions should not be considered limiting.

A voltage generator 42 is attached to the housing 32 and is operable to charge the solvent within the solvent conduit 34.

In using the ESSI apparatus, the solvent is supplied to the solvent conduit 34 at a rate ranging from about 0.05 μL/min to about 50 μL/min. While the particular solvent used is dependent on the chemical nature of the liquid sample 10 in study, one example of an appropriate solvent mixture can be methanol and water with either 0.5% or 1% acetic acid, v/v, which is injected at a rate of about 5 μL/min to about 10 μL/min. A gas, typically an inert gas such as $N_2$, is supplied to the gas conduit 36 at pressures ranging from about 8 bar to about 25 bar. The voltage generator 42 is activated and provides a voltage potential, typically ranging from about −5 kV to about 5 kV, to the solvent through the housing 32. This generates an electrically charged solvent within the solvent conduit 34.

The now electrically charged solvent traverses the solvent conduit 34 to the solvent conduit outlet 40. There, the charged solvent is impacted by the surrounding high-pressure gas leaving the gas conduit outlet 38. This high-pressure gas causes the flow of the charged solvent to be nebulized into the charged and nebulized solvent 14, which then impacts the liquid sample 10 at an angle, θ, with respect to an x-y plane defined by the surface 20 of the sample stage 22. This θ will cause desorption and deflection of a portion of the liquid sample 10 into the mass analyzer 30. While θ can range from about 30° to about 45°, an appropriate value of θ will increase the likelihood of the liquid sample 10 entering the mass analyzer 30.

While not wishing to be bound by theory, it is believed that the mechanism by which the charged and nebulized solvent 14 interacts with the liquid sample 10 and desorbs at least a portion of the liquid sample 10 can be chemical sputtering, charge transfer, or droplet pick-up. The most likely of these mechanisms being droplet pick-up. During droplet pick-up, the charged and nebulized solvent 14 interacts with the liquid sample 10 to yield desorbed secondary charged droplets of analyte. The secondary charged droplet will then undergo desolvation to yield ions of the analyte, i.e., gas phase ions.

The nebulizing ionizer 12 is interfaced to a cavity of the mass analyzer 30, which includes a mass filter 54 and the mass detector 56 maintained at vacuum. This interface can aid in desolving the solvent from the secondary charged droplet to form the ions of analyte. The ions of analyte enter the mass analyzer 30 through an orifice 44 of a plate 46, which provides an opening into the mass analyzer 30 while maintaining vacuum pressures. The ions of analyte are then directed to a skimmer 48, which can be constructed as a cone-shaped plate 50 having an orifice 52, and is operable to focus the ions of analyte into a narrow beam (not shown) of ion current as it enters the mass analyzer 30. This skimmer 48 is typically grounded. In some embodiments, the mass analyzer 30 can further include a separate focusing lens (not shown) between the skimmer 48 and the mass filter 54 to focus the ion current and reduce the natural expansion of the ion current by effusion through the orifice 52 of the skimmer 48.

After passing the skimmer 48, the ion current is directed to the mass filter 54. Conventional mass filters 54 include time-of-flight, quadrupolar, sector, or ion trap, which are operable to cause ions of analyte having a specified mass-to-charge (m/z) ratio to transverse the mass filter 54 and be quantified at the mass detector 56. One particularly suitable instrument is the hybrid triple-quadrupole-linear ion trap mass spectrometer, Q-trap 2000, by Applied Biosystems/MDS Sciex (Concord, Canada).

In operation of a conventional quadrupole modality, ion current is directed through four parallel electrodes, wherein the four parallel electrodes are comprised of two pairs of electrodes. A radiofrequency field and a DC voltage potential are applied to each of the two pairs of electrodes by a power supply such that the two pairs differ in polarity of the voltage potentials. Only the ions within the ion current having a particular m/z will continue through the parallel electrodes to the mass detector 56; that is, the ions will be equally attracted to and deflected by the two pairs of electrodes while the mean free path induced by the radiofrequency field onto the ion of analyte does not exceed distance between the electrodes. Thus, the ion of analyte having the particular m/z will balance the radiofrequency and DC voltage forces from the parallel electrodes, and will thereby traverse the parallel electrodes and impact the mass detector 56.

Those ions that reach the mass detector 56, typically a Faraday plate coupled to a picoammeter, are measured as a current (I) induced by a total number (n) of ions impacting the mass detector 56 over a period of time (t) and in accordance with n/t=I/e, wherein e is the elementary charge.

Operation of the mass filter 54 and the mass detector 56 can be by way of a controller 58. A suitable controller 58 can be a standard PC computer; however, the present invention should not be considered so limited Turning now to FIG. 2 in which like reference numerals refer to like features in FIG. 1, the LS-DESI-MS is shown in operation with an electrochemical cell 60, which is positioned between the continuous-flow pump 18 and the sample stage 22. A potential bias coupled to the electrochemical cell 60 can induce a chemical reaction, such as a redox reaction or electrolysis.

Electrochemical cells are devices that are used to generate an electromotive force and current as a result of a chemical reaction or to induce a chemical reaction. In the illustrative embodiment, the electrochemical cell 60 is a thin-layer electrochemical flow cell 62, such as a commercially-available LCEC Flowcell device from BioAnalytical Systems, Inc. (West Lafayette, Ind.). The thin-layer electrochemical flow cell 62 includes a sample inlet 64 and a sample outlet 66 and is operably coupled to a potentiostat 68. The potentiostat 68 provides and controls the electrical voltage levels supplied to a working electrode 70, a reference electrode 72, and a counter electrode 74 of the thin-layer electrochemical flow cell 62. The working electrode 70 can be constructed from glass carbon, the reference electrode 72 can be constructed from Ag/AgCl, and the counter electrode 74 can be a stainless steel block. While the electrochemical cell 60 is specifically illustrated as the thin-layer electrochemical flow cell 62, one of ordinary skill in the art would appreciate that other electrochemical cells can be used, some of which are described in detail below.

A first conduit, illustrated as capillary 76, joins the continuous-flow pump 18 to the sample inlet 64 of the thin-layer electrochemical flow cell 62 while a second conduit, illustrated as capillary 78, extends from the sample outlet 66 to the sample stage 22 in a manner that was described previously with reference to FIG. 1. The second capillary 78 should delivery the liquid sample 10 to the sample stage 22 without interacting with the particular reaction in study. For example, the second capillary 78 can be constructed from fused silica having an inner diameter ranging from about 0.05 mm to about 0.1 mm and a length ranging from about 3 cm to about 10 cm; however, these dimensions should not be considered limiting.

In use, the liquid sample 10 is pumped from the continuous-flow pump 18 to the electrochemical cell 60 where the voltage potential applied by the working electrode 70 induces reduction or oxidation of a chemical species within the liquid sample 10. The liquid sample 10 with the reduced/oxidized species flows through the second capillary 78 to the sample stage 22. There the reduced/oxidized species can undergo desorption and desolvation in a manner consistent with the methods described previously.

Figure 2:
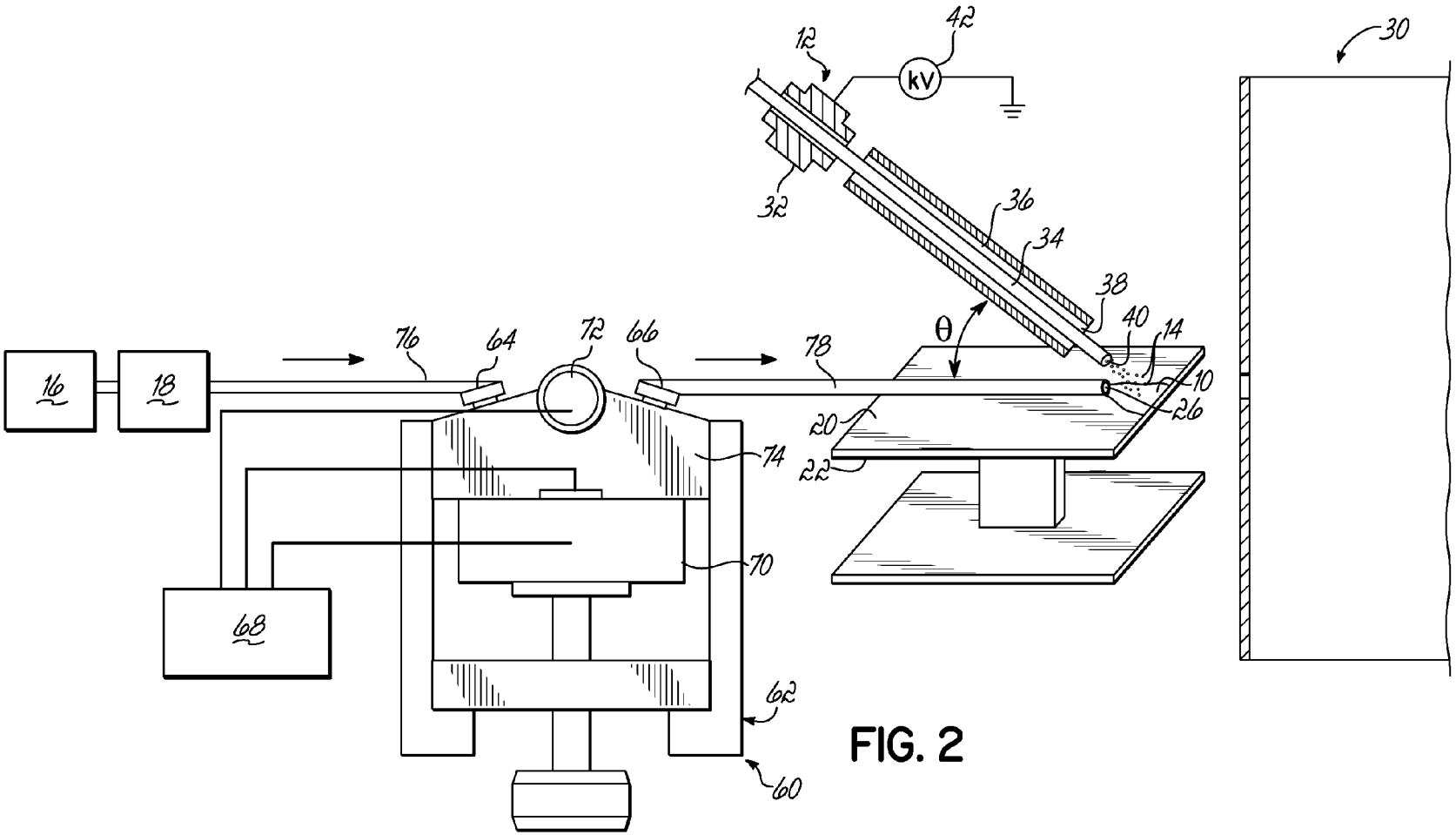
FIG. 2 is a diagrammatic view of the ionization apparatus of FIG. 1 coupled to a thin-layer electrochemical cell.
Figure 3:
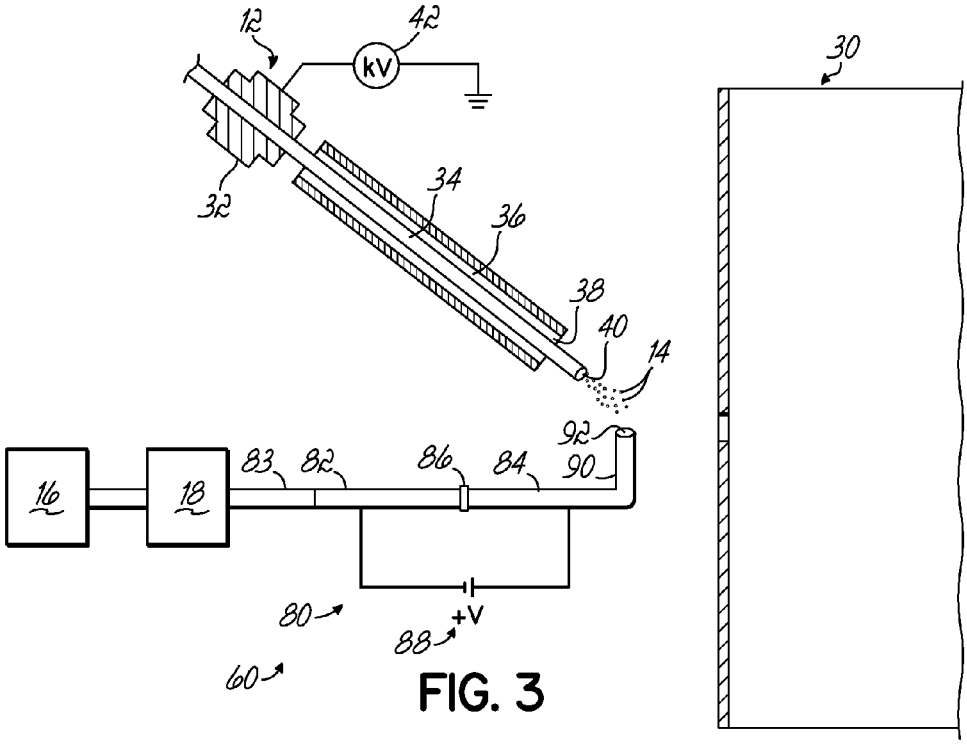
FIG. 3 is a diagrammatic view of another exemplary embodiment of the ionization apparatus including a tubular flow-through electrochemical cell.

With reference now to FIG. 3 in which like reference numerals refer to like features in FIGS. 1-2 and in accordance with an alternative embodiment, the LS-DESI-MS is shown in operation with a tubular flow-through electrochemical cell 80. As shown, a cathode 82 is coupled to a tube 83 extending from the continuous flow pump 18. The cathode 82 is bridged to an anode 84 via a polyaryletheretherketone (PEEK) union 86. The cathode and anode 82, 84 are preferably constructed from stainless steel, are 6 cm in length, have a 127 μm inner diameter, and a 1.55 mm outer diameter. However, these dimensions should not be considered limiting.

A voltage generator 88 is coupled to the cathode and anode 82, 84 and is operable to provide a voltage potential sufficient to cause an electrolysis reaction within the liquid sample 10 within the cathode and anode 82, 84.

As illustrated, a distal end 90 of the anode 84 can be bent to be approximately orthogonal with respect to an axis defined by a horizontal plane. The bent distal end 90 provides a sample surface 92 from which the liquid sample 10 can be desorbed using the nebulizing ionizer 12 and in a manner consistent with the methods described previously. As illustrated, the anode 84 is the conduit that is used to deliver the liquid sample 10 such that the liquid sample 10 can be directly ionized, which shortens the response time of the coupling device.

Though not shown, it would be understood that bending of the distal end 90 is not necessary. Instead, the anode 84 could be positioned onto a sample stage 22 (FIG. 1) in a manner consistent with the illustrative embodiment of FIG. 1.

Figure 4:
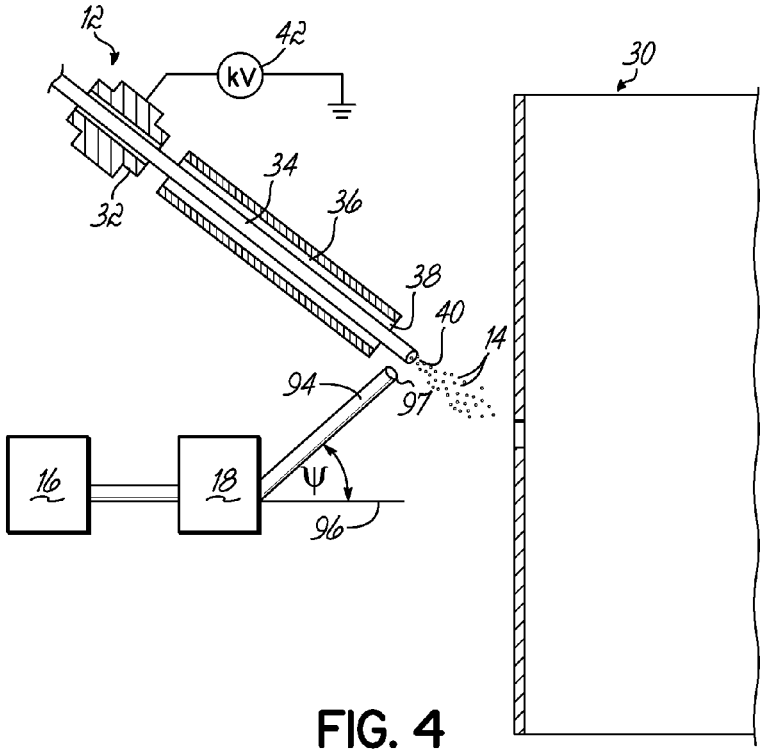
FIG. 4 is a diagrammatic view of an alternate embodiment of the ionization apparatus illustrated in FIG. 3.

With reference now to FIG. 4 in which like reference numerals refer to like features in FIGS. 1-3 and in accordance with an alternative embodiment where the LS-DESI-MS shown includes a tube 94 that extends at an angle, ψ, from the continuous flow pump 18 and with respect to a horizontal plane 96. Accordingly, the illustrative embodiment removes the sample stage 22 (FIG. 1). The charged and nebulized solvent 14 from the nebulizing ionizer 12 is directed toward a distal opening 97 of the tube 94. Accordingly, at least a portion of the liquid sample can be desorbed from the opening 97 and toward the mass analyzer 30. While not shown, the tube 94 can be supported by structures or clamps in a manner that would be known to one that is skilled in the art.

The angle, ψ, can vary so long as the solvent conduit outlet 40 of the nebulizing ionizer 12, the distal opening 97 of the tube 94, and the opening to the mass analyzer 30 are in line.

Figure 5:
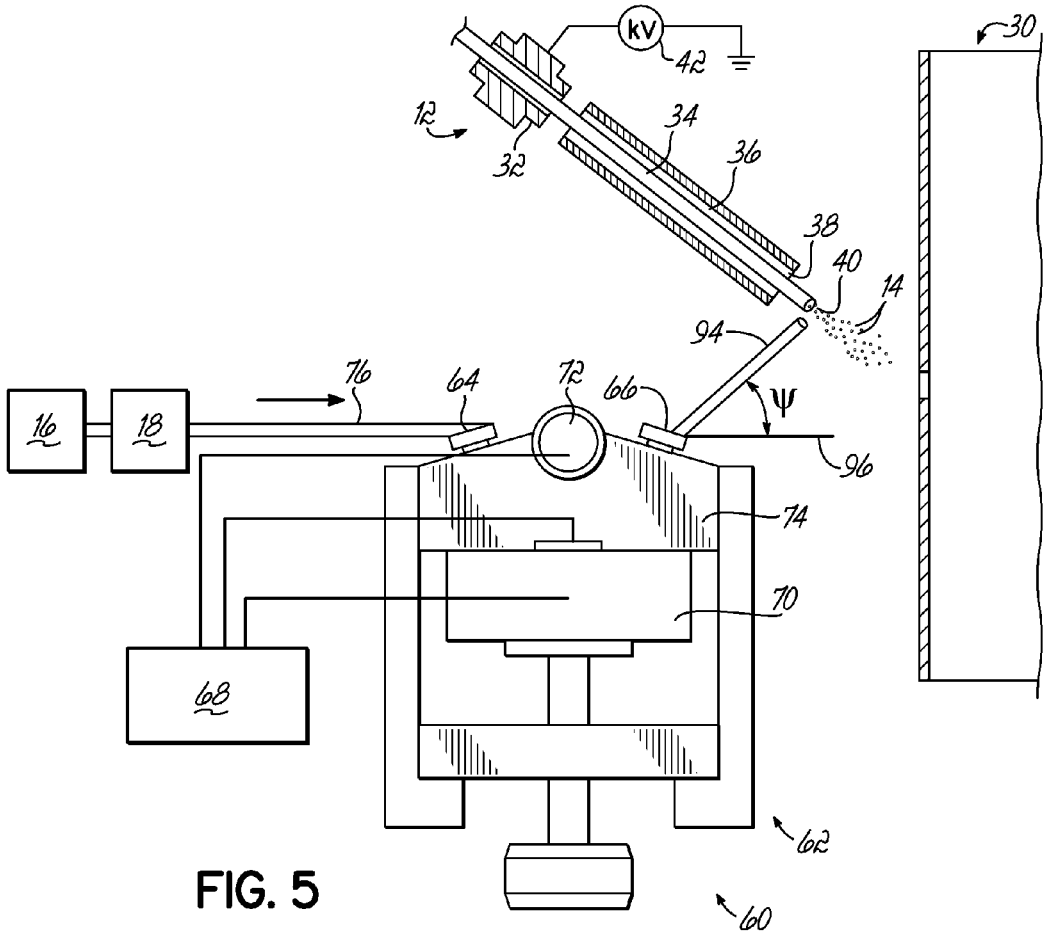
FIG. 5 is a diagrammatic view of an alternate embodiment of the ionization apparatus of FIG. 4 coupled to a thin-layer electrochemical cell.

With reference now to FIG. 5 in which like reference numerals refer to like features in FIGS. 1-4 and in accordance with an alternative embodiment, the LS-DESI-MS apparatus of FIG. 4 further includes the thin-layer electrochemical flow cell 62 of FIG. 2 for the analysis of species produced in electrolysis. Accordingly the proximal end of the tube 94 is coupled to the outlet 66 of the thin-layer electrochemical flow cell 62.

Figure 6:
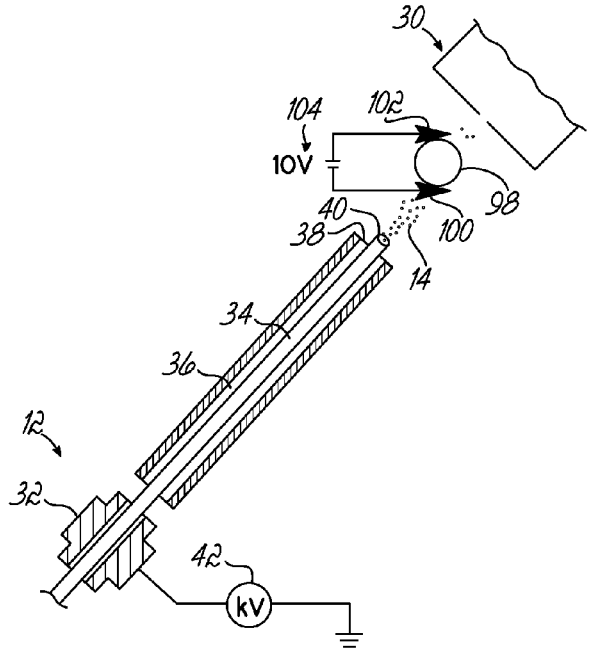
FIG. 6 is a diagrammatic view of another exemplary embodiment of an ionization apparatus for the analysis of a droplet of a liquid sample.

With reference now to FIG. 6 in which like reference numerals refer to like features in FIGS. 1-5 and in accordance with an alternative embodiment, a small volume analysis LS-DESI-MS apparatus is described. A droplet 98 of the liquid sample 10 is suspended between first and second electrodes 100, 102. In one embodiment, surface tension is used to suspend the droplet 98. The droplet 98 can range in volume from nanoliters to microliters, generally, but is preferably about 10 μL in volume. The two electrodes 100, 102 are preferably constructed from copper or platinum and are coupled to a voltage generator 104. The charged and nebulized solvent 14 generated by the nebulizing ionizer 12 is directed at the droplet 98. While the illustrative embodiment shows the nebulizing ionizer 12 directed at an upwardly angle toward the droplet 98, it would be understood that this is exemplary in nature and the direction is not limited to the one shown.

In use, the voltage generator 104 is activated to initiate an electrolysis reaction within the droplet 98. After an amount of time, preferably approximately three minutes, the nebulizing ionizer 12 is activated and a portion of the droplet 98 is desorbed and analyzed in accordance with the methods that were described previously. The droplet embodiment provides the benefit of utilizing a small amount of liquid sample 10, which limits the volume that is required for analysis and can potentially allow for high throughput of analysis if applied in a miniaturized array.

Though not specifically shown, it would be understood that the droplet embodiment could be used without providing the voltage potential necessary for electrolysis. Accordingly, analytes within the liquid sample 10 could be analyzed using non-electrochemical procedures.

The following examples illustrate particular properties and advantages of some of the embodiments of the present invention.

EXAMPLE 1

Figure 7:
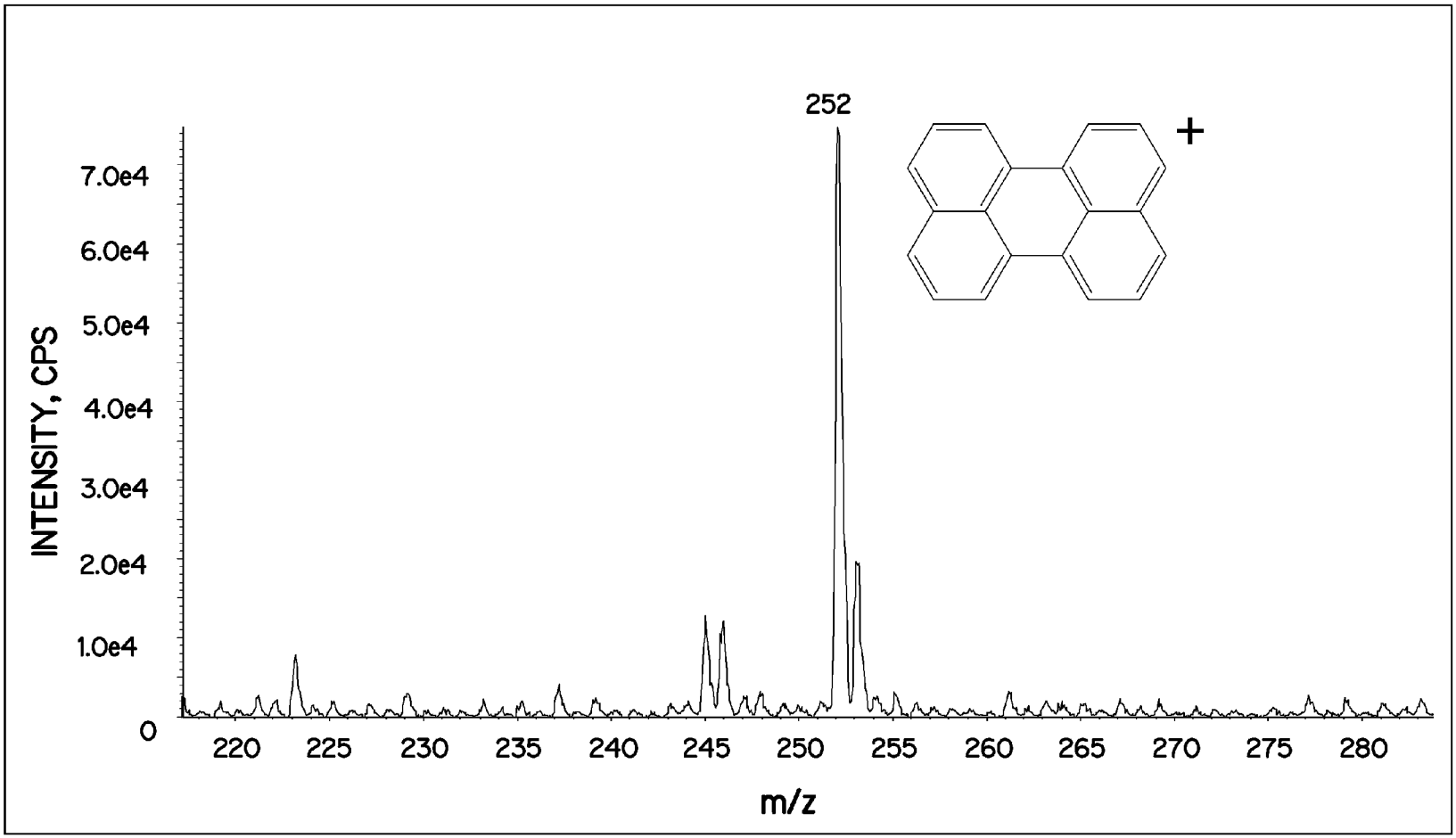
FIG. 7 is an exemplary spectrum of a perylene radical cation obtained from a device similar to the ionization apparatus illustrated in FIG. 3.

A 0.1 mM of perylene solution was prepared in a mixed solvent of $CH_3CN$ and $CH_2Cl_2$ (1:1 by volume) containing 40 mM lithium triflate (added as electrolytes) and was infused into a device similar to the tubular flow-through electrochemical cell 60 illustrated in FIG. 3. The continuous flow pump 18 was operated at a flow rate of 10 μL/min. A DC potential of 10 V was applied to the tubular flow-through electrochemical cell 60 for electrolysis. As the perylene solution (0.1 mM) was infused into the tubular flow-through electrochemical cell 60, the perylene is oxidized and forms the perylene radical cation (m/z 252), which is directly transferred into the gas phase by DESI for mass spectrometric detection. Using a Q-trap 2000 mass spectrometer by Applied Biosystems/MDS Sciex, the perylene radical cation was detected, see FIG. 7. Removal of the DC potential resulted in the loss of the m/z 252 signal.

EXAMPLE 2

Figure 8A:
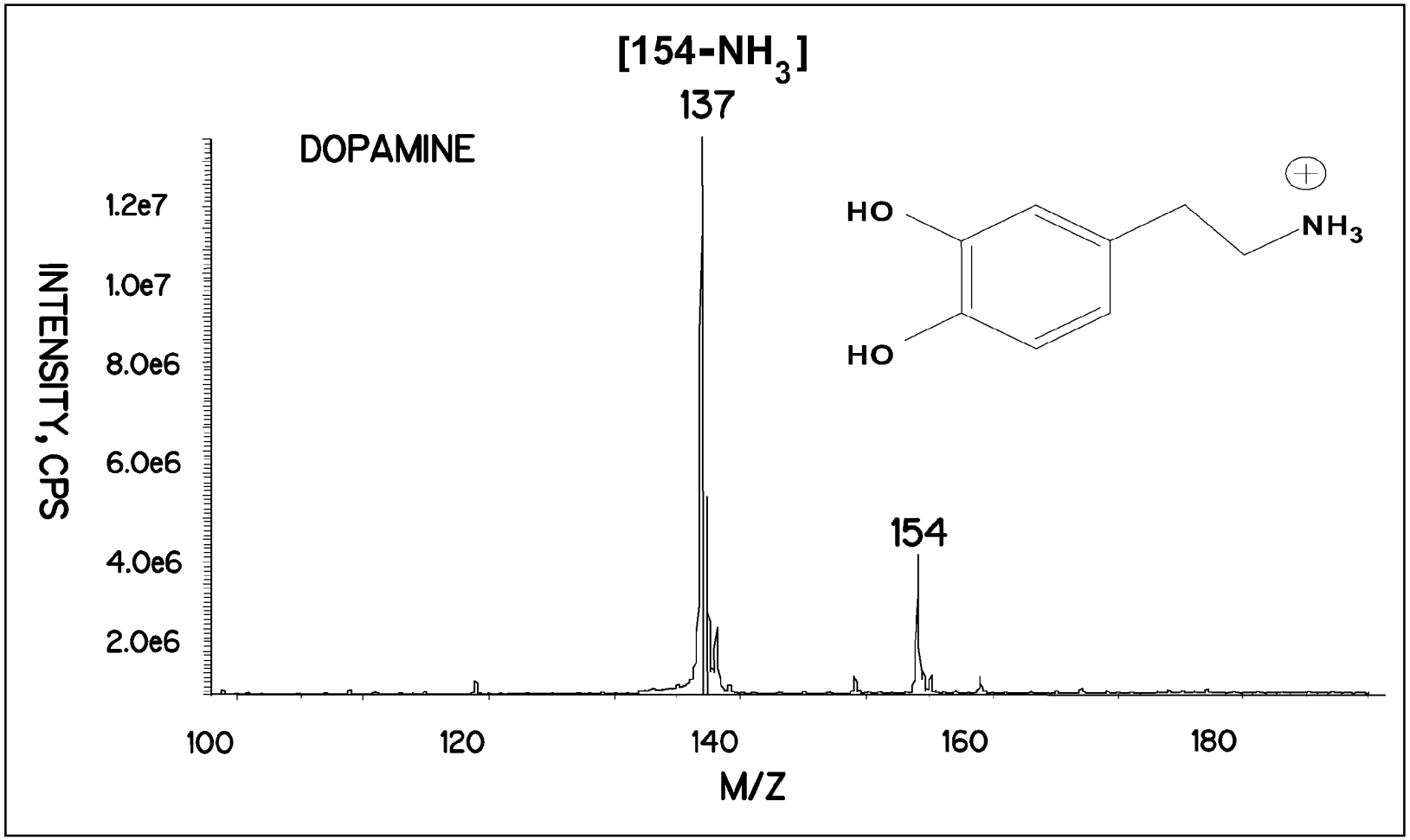
FIG. 8A is an exemplary spectrum of a protonated dopamine obtained from a device similar to the ionization apparatus illustrated in FIG. 5 with no voltage applied to the electrochemical cell.
Figure 8B:
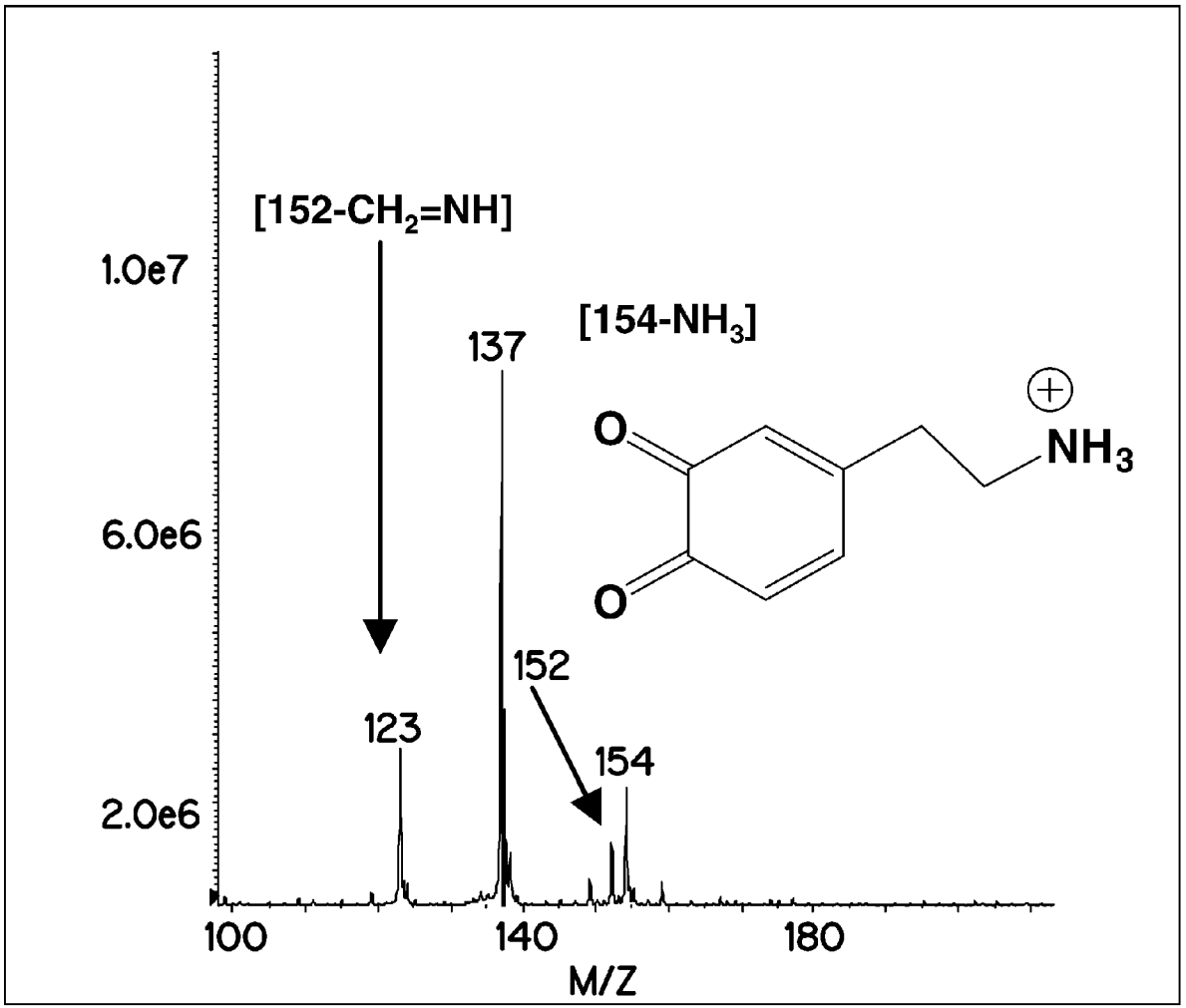
FIG. 8B is an exemplary spectrum of the oxidized dopamine product from the device used in obtaining the spectrum of FIG. 8A but with a voltage applied to the electrochemical cell.

Dopamine, a classical compound for electrochemical reaction tests, was used to examine the performance of a device similar to the thin-layer electrochemical flow cell 62 illustrated in FIG. 5. A 1.0 mM of dopamine solution was prepared in $H_2O/CH_3OH$ (1:1 by volume) containing 1% HOAc and allowed to flow through the thin-layer electrochemical cell 62. The spectrum in FIG. 8A illustrates the detection of the protonated dopamine at m/z 154 when no voltage is applied to the thin-layer electrochemical cell 62 from the potentiostat 68. The spectrum in FIG. 8B illustrates the application of voltage to the thin-layer electrochemical 62 from the potentiostat 68 and the resultant detection of the protonated ion of the oxidized dopamine (m/z 152). FIG. 8B further illustrates the fragment ion of m/z 123 generated by dissociation of $CH_2{=}NH$ from the dopamine by collision induced dissociation (CID).

As demonstrated in FIGS. 8A and 8B, the non-volatile oxidized dopamine is generated by electrosis, directly ionized DESI, and transferred to the gas phase for detection by mass spectrometry. There is no detectable signal of m/z 152 in FIG. 8A, which would indicate that the desorption and ionization by DESI does not oxidize the dopamine, which had been problematic in conventional methods of coupling EC with MS.

Figure 8C:
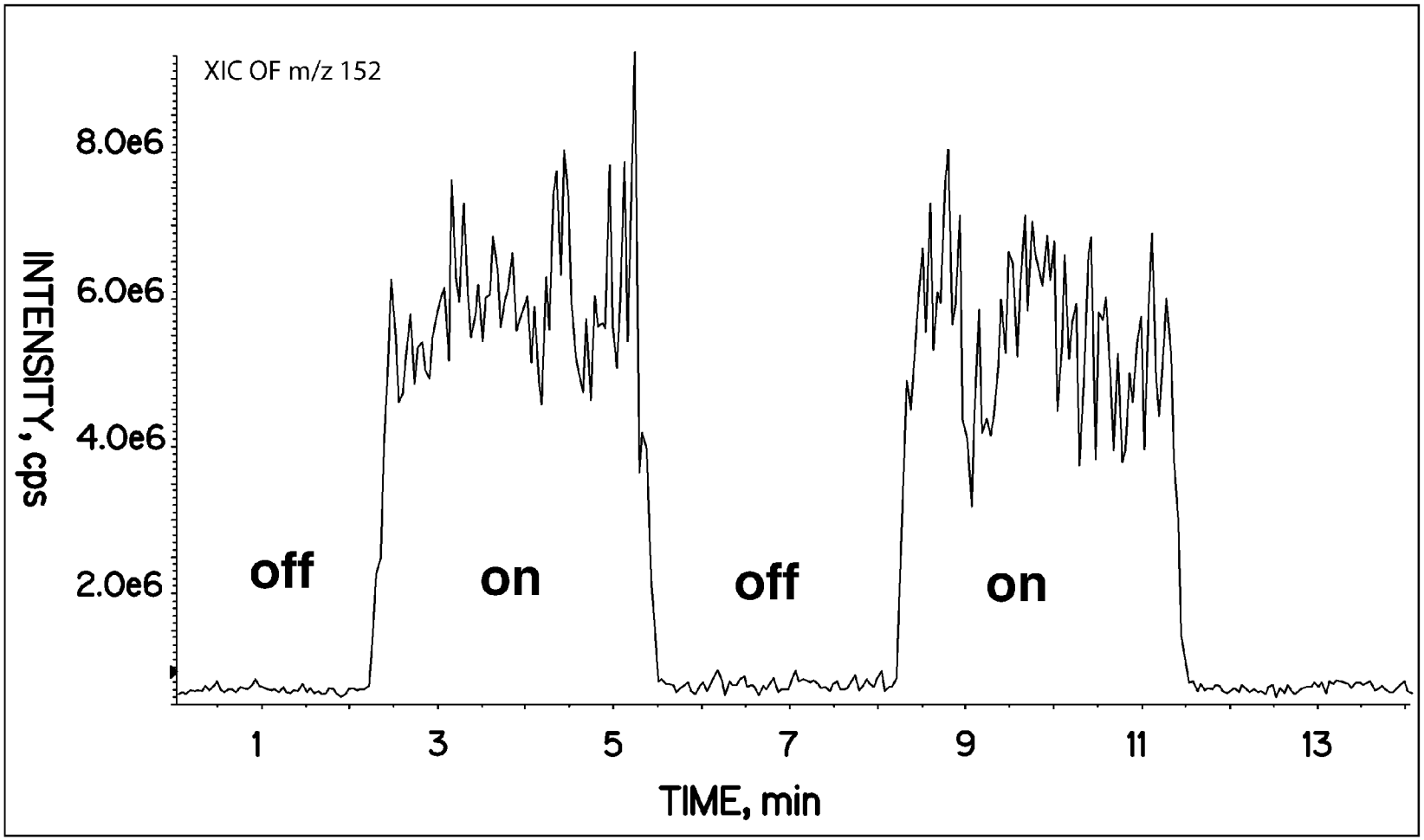
FIG. 8C is an extracted ion chromatogram for the device used in obtaining the spectra of FIGS. 8A-B.

FIG. 8C illustrates an extracted ion chromatogram of m/z 152, which provides the response time for the thin-layer electrochemical cell, i.e., the time it takes a species to travel from the thin-layer electrochemical cell to the mass spectrometer. For the exemplary apparatus, the response time was calculated to be 3.6 seconds when the flow rate of liquid sample injection was 30 μL/min and a short piece of tube (about 3.8 cm) was used. This response time is shorter than the reported 5 second value demonstrated by devices using conventional methods of coupling EC with MS.

EXAMPLE 3

Figure 9:
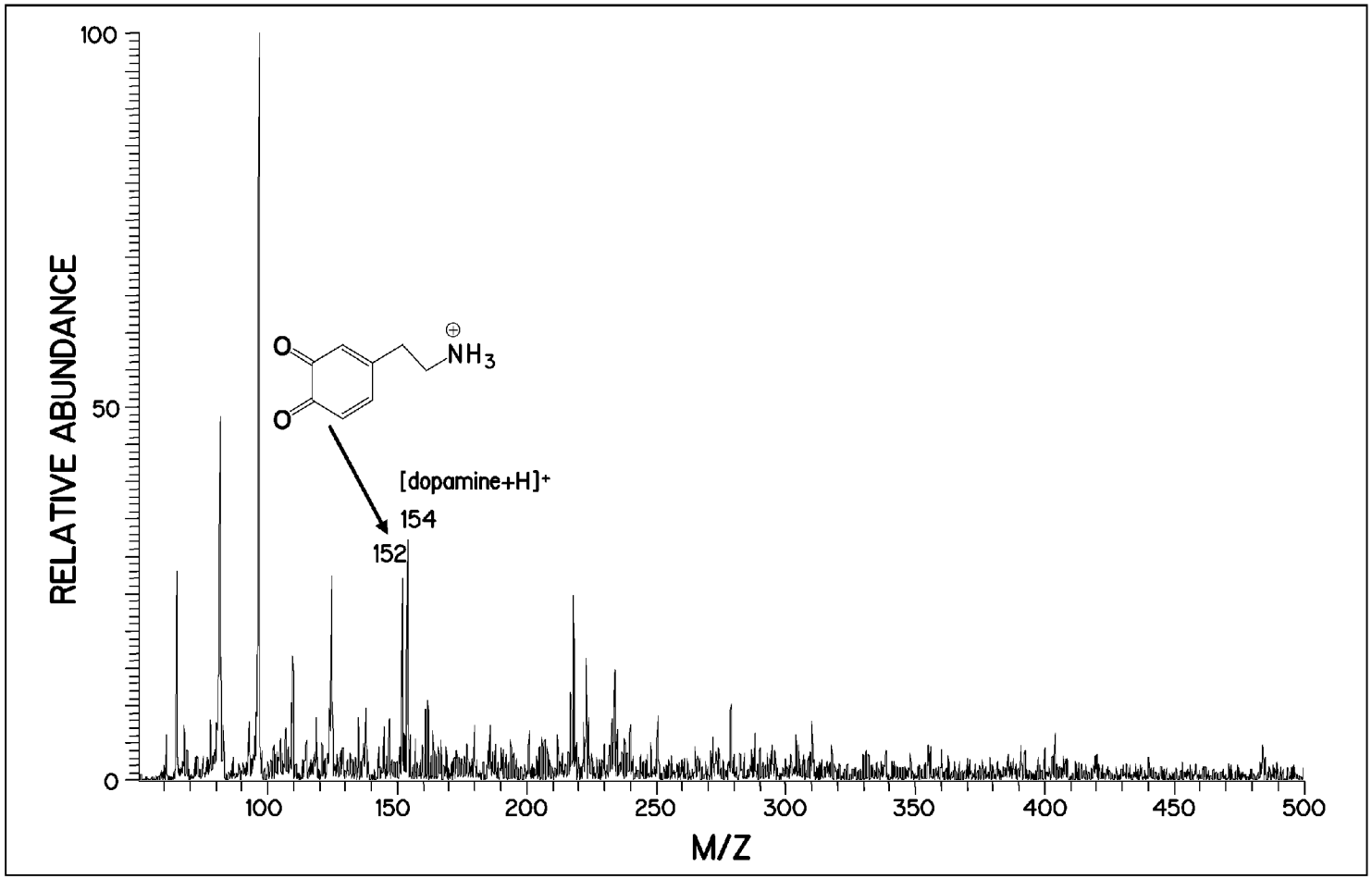
FIG. 9 is an exemplary spectrum of oxidized dopamine obtained from a device similar to the ionization apparatus illustrated in FIG. 6.

A small liquid droplet (about 10 μL) containing dopamine analyte was suspended between two small copper metal electrodes of a device similar to the small volume EC/DESI-MS apparatus shown in FIG. 6. A 10 V voltage potential was applied to the electrodes from the voltage generator 104 for approximately 3 minutes to oxidize the dopamine. The nebulizing solvent is directed toward the electrolyzed droplet and a portion of the oxidized dopamine is desorbed. Using an LCQ Deca mass spectrometer by Thermo Finnigan, a m/z 152 signal was detected (see FIG. 9), which corresponds to oxidized dopamine.

As provided for herein, an apparatus that simplifies the coupling of EC with MS while operating under ambient conditions has been described. The apparatus and methods remove the dead connection volume between conventional electrochemical cells and ionization sources. The apparatus and methods further allow for the analysis of a small volume, which preserves liquid sample and allows for high throughput analysis.

This has been a description of the present invention along with the various methods of practicing the present invention. However, the invention itself should only be defined by the appended claims.

What is claimed is:

1. An electrochemical liquid sample ionizer comprising:
- an electrochemical cell;
- a potential bias sufficient to oxidize or reduce a liquid sample in the electrochemical cell, thereby electrolyzing the liquid sample;
- said electrochemical cell having an electrolyzed sample outlet; and
- an ambient ionizer configured to desorb and ionize at least a portion of the electrolyzed liquid sample, said ambient ionizer including a charged nebulized solvent outlet positioned to project said charged nebulized solvent against electrolyzed sample emitted from said sample outlet.

2. The electrochemical liquid sample ionizer of claim 1 further comprising:
- a conduit having an inlet adapted to receive the electrolyzed liquid sample from the electrochemical cell and wherein said outlet is distal to the electrochemical cell.

3. The electrochemical liquid sample ionizer of claim 2 further comprising:
- a sample stage adapted to receive the electrolyzed liquid sample from the conduit.

4. The electrochemical liquid sample ionizer of claim 3, wherein the sample stage is a polytetrafluoroethylene or glass.

5. The electrochemical liquid sample ionizer of claim 2, wherein the conduit is constructed from a material selected from a group consisting of silica, stainless steel, and aluminum.

6. The electrochemical liquid sample ionizer of claim 1, wherein the ambient ionizer generates a charged, nebulized solvent for desorbing and ionizing the electrolyzed liquid sample.

7. The electrochemical liquid sample ionizer of claim 1 further comprising:

a continuous flow pump in fluid communication with the electrochemical cell, the continuous flow pump configured to pump the liquid sample at a rate of about 0.1 μL/min to about 10 μL/min.

8. The electrochemical liquid sample ionizer of claim 1, wherein the electrochemical cell is a thin-layer electrochemical cell having a working electrode, a reference electrode, and a counter electrode.

9. The electrochemical liquid sample ionizer of claim 1, wherein the electrochemical cell is a tubular flow-through electrochemical cell having a cathode, an anode, and a polyaryletheretherketone union bridging the cathode and the anode.

10. The electrochemical liquid sample ionizer of claim 9, wherein the electrolyzed liquid sample is directly desorbed and ionized from an outlet of the anode.

11. The electrochemical liquid sample ionizer of claim 10, wherein a distal portion of the anode is bent in a direction that is generally toward the ambient ionizer.

12. An electrochemical liquid sample ionizer comprising:

an electrochemical cell;

a potential bias coupled to the electrochemical cell and configured to supply an energy sufficient to oxidize or reduce a liquid sample in the electrochemical cell, thereby electrolyzing the liquid sample;

a sample stage adapted to receive the electrolyzed liquid sample from the electrochemical cell; and an ambient ionizer configured to desorb and ionize at least a portion of the electrolyzed liquid sample.

13. The electrochemical liquid sample ionizer of claim 12, wherein the ambient ionizer generates a charged, nebulized solvent for desorbing and ionizing the electrolyzed liquid sample.

14. The electrochemical liquid sample ionizer of claim 12 further comprising:

a continuous flow pump adapted to pump the electrolyzed liquid sample at a rate of about 0.1 μL/min to about 10 μL/min onto the sample stage.

15. The electrochemical liquid sample ionizer of claim 12, wherein the sample stage is a polytetrafluoroethylene or glass.

16. The electrochemical liquid sample ionizer of claim 12 further comprising:

a conduit adapted to deliver the electrolyzed liquid sample to the sample stage.

17. The electrochemical liquid sample ionizer of claim 16, wherein the conduit is constructed from a material selected from a group consisting of silica, stainless steel, and aluminum.

18. The electrochemical liquid sample ionizer of claim 12, wherein the electrochemical cell is a thin-layer electrochemical cell having a working electrode, a reference electrode, and a counter electrode.

19. The electrochemical liquid sample ionizer of claim 12, wherein the electrochemical cell is a tubular flow-through electrochemical cell having a cathode, an anode, and a polyaryletheretherketone union bridging the cathode and the anode.

20. An electrochemical liquid sample ionizer comprising:

first and second electrodes having a droplet of liquid sample disposed therebetween;

a potential bias coupled to the first and second electrodes and configured to supply an energy sufficient to oxidize or reduce the liquid sample in the droplet, thereby electrolyzing the liquid sample; and an ambient ionizer configured to emit a nebulized charged solvent directed at said droplet of liquid sample to desorb and ionize at least a portion of the droplet electrolyzed liquid sample.

21. The electrochemical liquid sample ionizer of claim 20, wherein the ambient ionizer generates a charged, nebulized solvent for desorbing and ionizing the electrolyzed liquid sample.

22. The electrochemical liquid sample ionizer of claim 20, wherein the first and second electrodes are copper or platinum.

23. A mass spectrometer comprising:

(i) an electrochemical liquid sample ionizer comprising:

(a) an electrochemical cell;

(b) a potential bias coupled to the electrochemical cell and configured to supply an energy sufficient to oxidize or reduce a liquid sample in the electrochemical cell, thereby electrolyzing the liquid sample; and said electrochemical cell having an electrolyzed sample outlet; and (c) an ambient ionizer configured to desorb and ionize at least a portion of the electrolyzed liquid sample into gas phase ions; said ambient ionizer including a charged nebulized solvent outlet positioned to project said charged nebulized solvent against electrolyzed sample emitted from said sample outlet and (ii) a mass analyzer connected to the electrochemical liquid sample ionizer and configured to analyze a mass-to-charge ratio of the gas phase ions.

24. The mass spectrometer of claim 23 further comprising:

a controller configured to operate the ion source, the mass analyzer, or a combination thereof.

25. The mass spectrometer of claim 23, wherein the ion source further comprises:

a conduit having an inlet adapted to receive the electrolyzed liquid sample from the electrochemical cell and having an outlet that is distal to the electrochemical cell.

26. The mass spectrometer of claim 25 further comprising:

a sample stage adapted to receive the electrolyzed liquid sample from the conduit.

27. The mass spectrometer of claim 26, wherein the sample stage is a polytetrafluoroethylene or glass.

28. The mass spectrometer of claim 25, wherein the conduit is constructed from a material selected from a group consisting of silica, stainless steel, and aluminum.

29. The mass spectrometer of claim 23, wherein the ambient ionizer generates a charged, nebulized solvent for desorbing and ionizing the electrolyzed liquid sample.

30. The mass spectrometer of claim 23 further comprising:

a continuous flow pump in fluid communication with the electrochemical cell and configured to pump the electrolyzed liquid sample at a rate of about 0.1 μL/min to about 10 μL/min.

31. The mass spectrometer of claim 23, wherein the electrochemical cell is a thin-layer electrochemical cell having a working electrode, a reference electrode, and a counter electrode.

32. The mass spectrometer of claim 23, wherein the electrochemical cell is a tubular flow-through electrochemical cell having a cathode, an anode, and a polyaryletheretherketone union bridging the cathode and the anode.

33. The mass spectrometer of claim 32, wherein the electrolyzed liquid sample is directly desorbed and ionized from an outlet of the anode.

34. The mass spectrometer of claim 33, wherein a distal portion of the anode is bent in a direction that is generally toward the ambient ionizer.

35. A mass spectrometer comprising:

(i) an electrochemical liquid sample ionizer comprising:

(a) first mid second electrodes having a droplet of liquid sample disposed therebetween;

(b) a potential bias coupled to the first and second electrodes and configured to supply an energy sufficient to oxidize or reduce the liquid sample in the droplet, thereby electrolyzing the liquid sample; and (c) an ambient ionizer configured to emit a nebulized charged solvent directed at said droplet of liquid sample to desorb and ionize at least a portion of the electrolyzed liquid sample of the droplet into gas phase ions; and (ii) a mass analyzer connected to the electrochemical liquid sample ionizer and configured to analyze a mass-to-charge ratio of the gas phase ions.

36. The mass spectrometer of claim 35 further comprising: a controller configured to operate the ion source, the mass analyzer, or both.

37. The mass spectrometer of claim 35, wherein the ambient ionizer generates a charged, nebulized solvent for desorbing and ionizing the electrolyzed liquid sample.

38. The mass spectrometer of claim 35, wherein the first and second electrodes are copper or platinum.

* * * * *

UNITED STATES PATENT AND TRADEMARK OFFICE

CERTIFICATE OF CORRECTION

PATENT NO. : 8,330,119 B2
APPLICATION NO. : 12/558819
DATED : December 11, 2012
INVENTOR(S) : Hao Chen et al.

It is certified that error appears in the above-identified patent and that said Letters Patent is hereby corrected as shown below:

CLAIM 35

| | | |
|---|---|---|
| Column 7, Line 13, "(a) first mid second electrodes having" | should read | -- (a) first and second electrodes having -- |

Signed and Sealed this
Nineteenth Day of March, 2013

Teresa Stanek Rea
*Acting Director of the United States Patent and Trademark Office*